US005362161A

United States Patent [19]

Nagano

[11] Patent Number: 5,362,161

[45] Date of Patent: Nov. 8, 1994

[54] POWER SOURCE COMPENSATION FOR PRINTER

[75] Inventor: Fumikazu Nagano, Yamato-Koriyama, Japan

[73] Assignee: Sharp Kabushiki Kaisha, Osaka, Japan

[21] Appl. No.: 67,034

[22] Filed: May 26, 1993

[30] Foreign Application Priority Data

Jun. 17, 1992 [JP] Japan ..... 4-157945

[51] Int. Cl.[5] ..... B41J 2/37

[52] U.S. Cl. ..... 400/120.12; 346/76 PH; 400/74

[58] Field of Search ..... 400/74, 120; 346/76 PH

[56] References Cited

FOREIGN PATENT DOCUMENTS 242662 10/1988 Japan ..... 400/120

150557 6/1989 Japan ..... 400/120

OTHER PUBLICATIONS

Japanese Laid-Open Pat. Appln. No. 1-216862, laid open Aug. 30, 1989.

Japanese Laid-Open Pat. Appln. No. 61-185464, laid open Aug. 19, 1986.

*Primary Examiner*—David A. Wiecking

*Assistant Examiner*—Steven S. Kelley

[57] ABSTRACT

A power source for a printer has a power source unit for supplying power to the printer and lead wires for electrically connecting the power source unit to the printer. The power source unit includes a compensating circuit for compensating a reduction in voltage applied to the printer from the power source unit, and the compensating circuit detects a load electric current supplied to the printer only within the power source and is constructed such that the reduction in voltage is compensated in accordance with the load electric current.

2 Claims, 6 Drawing Sheets

POWER SOURCE COMPENSATION FOR PRINTER

BACKGROUND OF THE INVENTION

1. Field of the Invention

The present invention relates to a power source for a printer such as a thermal printer.

2. Description of the Related Art

A circuit structure in a general power source for a printer is provided to detect a power voltage or a voltage drop in a thermal head portion of the printer. In this case, it is necessary to locate a remote sensing line between a circuit for detecting the voltage drop and the power source or the thermal head portion. When a defect in a remote sensing connector is caused in the thermal head portion, a thermal voltage is excessively increased. Therefore, it is necessary to separately locate a circuit for protecting the thermal head portion from the excessive voltage.

In the above-mentioned general power source, an output voltage of the power source is reduced in accordance with an increase in printing amount so that a difference in density between printed characters is caused.

SUMMARY OF THE INVENTION

It is therefore an object of the present invention to provide a power source for a printer in which a reduction in voltage of the power source caused by an increase in printing amount is corrected only within the power source so that a stable voltage is applied to a load in order to provide printed characters having a uniform density.

The above object of the present invention can be achieved by a power source for a printer comprising a power source unit for supplying power to the printer and lead wires for electrically connecting the power source unit to the printer, and characterized in that the power source unit includes a compensating circuit for compensating a reduction in voltage applied to the printer from the power source unit, and the compensating circuit detects a load electric current supplied to the printer only within the power source and is constructed such that the reduction in voltage is compensated in accordance with the load electric current.

In the above power source, the compensating circuit detects a load electric current supplied to a printer only within the power source and is constructed such that a reduction in voltage applied to the printer is compensated in accordance with the load electric current. Accordingly, the reduction in power voltage caused by an increase in printing amount is corrected by only the power source unit so that a stable voltage can be applied to the printer. Further, when the power source of the present invention is used for the printer, it is possible to prevent a defect in a connector and an excessive voltage from being caused in the printer and obtain printed characters having a uniform density.

Further objects and advantages of the present invention will be apparent from the following description of the preferred embodiments of the present invention as illustrated in the accompanying drawings.

BRIEF DESCRIPTION OF THE DRAWINGS

FIG. 8 is a block diagram showing a power source unit, the thermal head and a control section.

DESCRIPTION OF THE PREFERRED EMBODIMENTS

The preferred embodiments of a power source for a printer in the present invention will next be described in detail with reference to the accompanying drawings.

Figure 1:
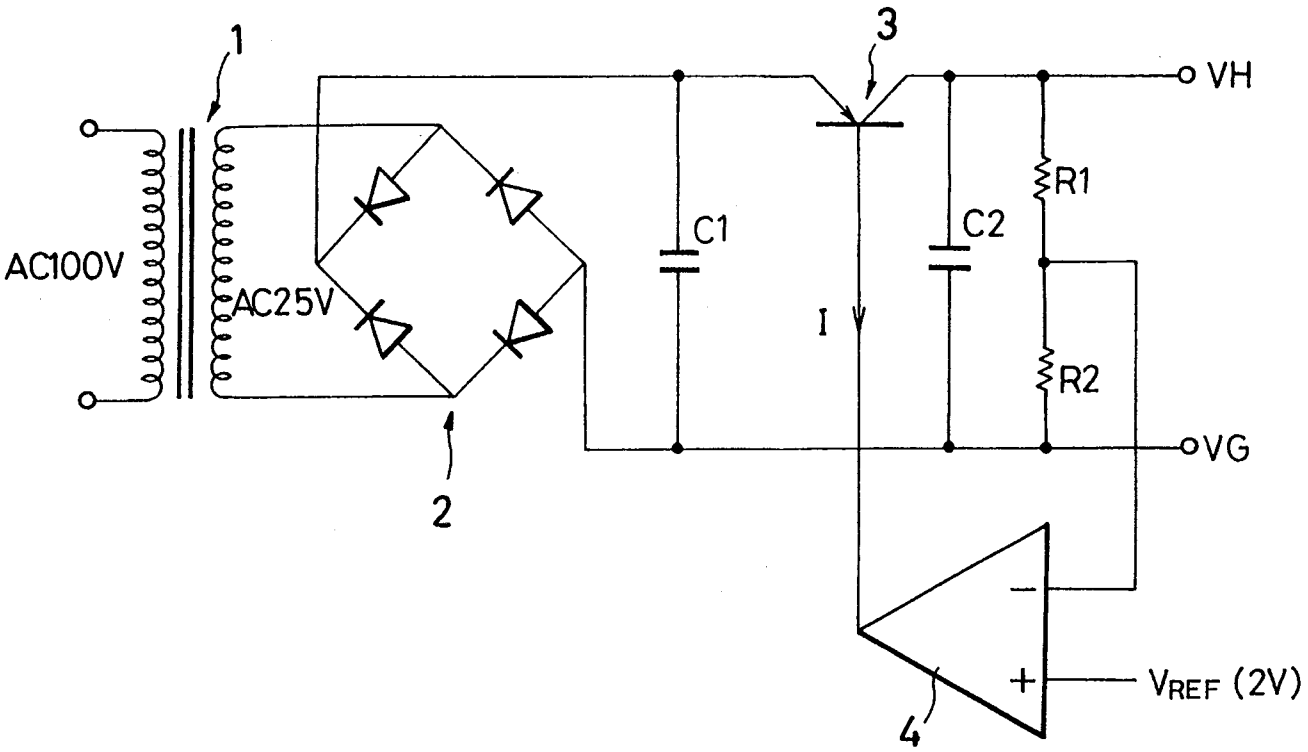
FIG. 1 is a circuit diagram showing a general power source for a thermal printer.

FIG. 1 shows a general power source for a printer.

In FIG. 1, reference numerals 1 and 2 respectively designate a transformer and a bridge circuit. Reference numerals C1 and C2 designate capacitors. References numerals and 4 respectively designate a-PNP-type transistor and a differential amplifier. A voltage $_{REF}$is set to two volts and is inputted to a plus (+) input terminal of the differential amplifier 4. Resistors R1 and R2 are respectively set to have 9 kΩ and 1 kΩ.

When a terminal voltage VG is set to zero and a difference (VH−VG) in terminal voltage is higher than 20 volts, an output electric current I of the differential amplifier 4 is reduced so that an electric current supplied to a load of the transistor 3 is reduced. Accordingly, the terminal voltage difference (VH−VG) is finally equal to 20 volts. Accordingly, the power source is designed such that $(VH-VG)=(R1+R2)V_{REF}/R2$ is formed.

Namely, such a circuit structure is provided to detect a power voltage or a voltage drop in a thermal head portion of the printer. In this case, it is necessary to dispose a remote sensing line between a circuit for detecting the voltage drop and the power source or the thermal head portion. When a defect in a remote sensing connector is caused in the thermal head portion, a thermal voltage is excessively increased. Therefore, it is necessary to separately dispose a circuit for protecting the thermal head portion from the excessive voltage.

In the above-mentioned general power source, an output voltage of the power source is reduced in accordance with an increase in printing amount so that a difference in density between printed characters is caused.

Figure 4:
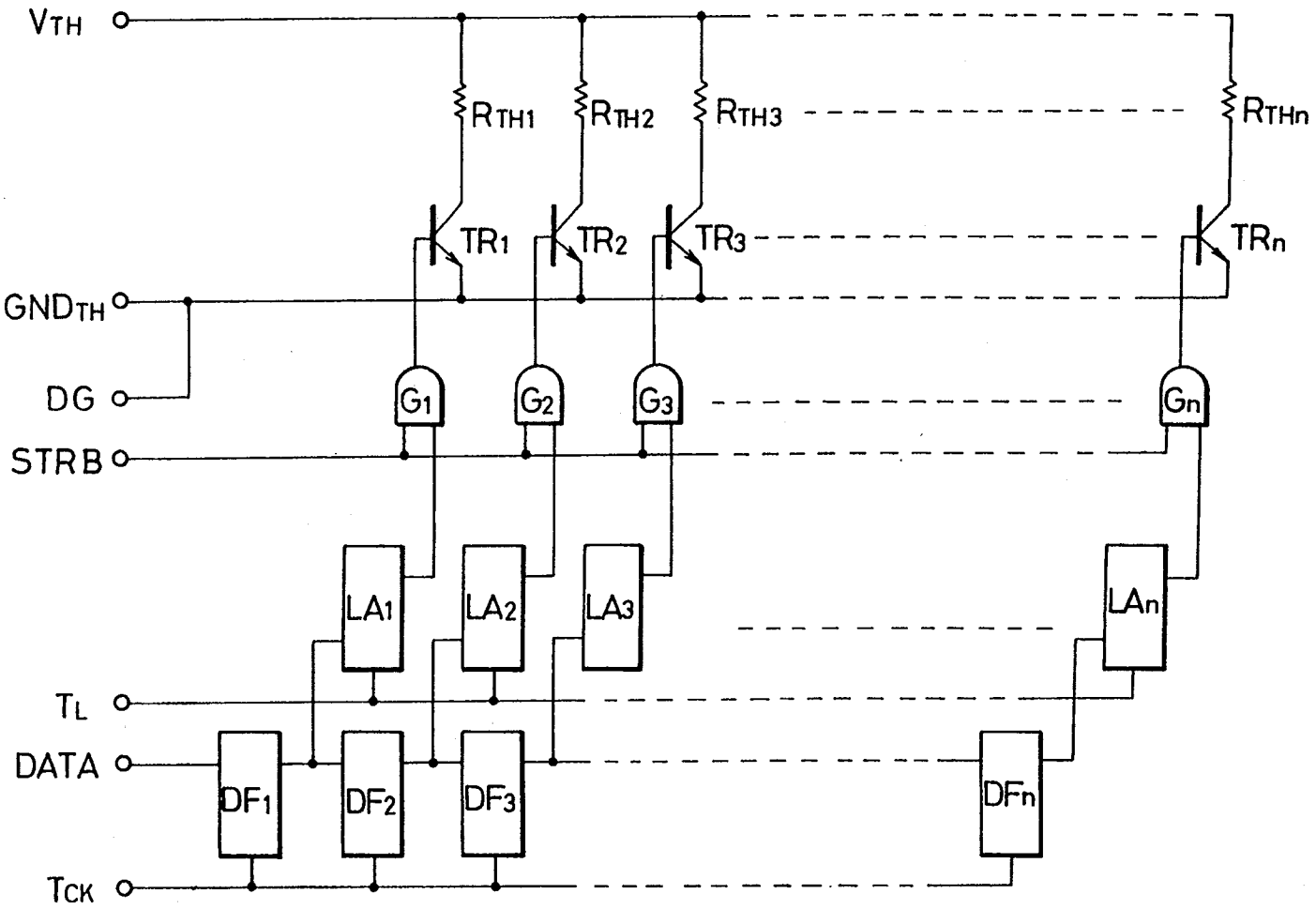
FIG. 4 is a circuit block diagram showing a thermal head of the thermal printer.

FIG. 4 is a circuit block diagram of a thermal head having n elements where n is set to two or more.

In FIG. 4, each of $DF_1$, $DF_2$,—, $DF_n$ designates a D-flip flop circuit. Each of $LA_1$, $LA_2$,—, $LA_n$ designates a latch circuit. Each of $G_1$, $G_2$,—, $G_n$designates a gate circuit. Each of $TR_1$, $TR_2$,—, $TR_n$ designates a driver transistor. Each of $R_{TH1}$, $R_{TH2}$,—, $R_{THn}$ designates a resistor. Reference numeral $V_{TH}$ designates a power source of the thermal head. $GND_{TH}$ and DG designate grounds of the thermal head. DATA designates a data input signal of a first flip-flop circuit $DF_1$ of the flip-flop circuits $DF_1$, $DF_2$,—, $DF_n$ constituting a shift register. $T_{CK}$ designates a clock signal. $T_L$ designates a clock signal for each of the latch circuits $LA_1$, $LA_2$,—, $LA_n$ for simultaneously latching outputs of the flip-flop circuits $DF_1$, $DF_2$,—, $DF_n$ constituting the shift register. An STRB signal is provided to respectively transmit outputs of the latch circuits $LA_1$, $LA_2$,—, $LA_n$ as a latch group to the driver transistors $TR_1$, $TR_2$,—, $TR_n$. When the STRB signal shows value "1", an electric current flows through each of resistors corresponding to outputs "1" of the latch circuits $LA_1$, $LA_2$,—, $LA_n$ as a latch group. Thus, these resistors are heated to record an image onto a piece of paper.

Figure 5:
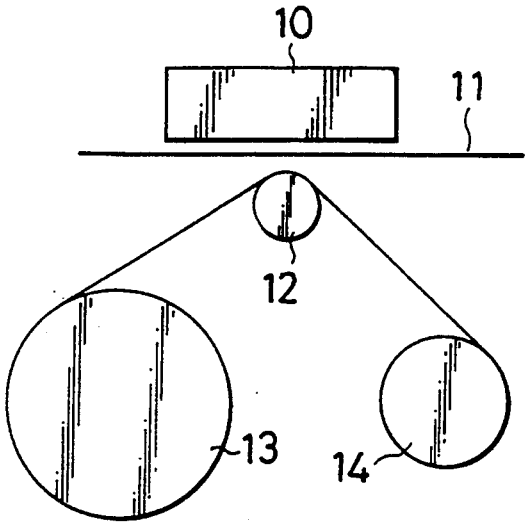
FIG. 5 is a view showing one example of a printing section of the printer.

FIG. 5 shows one example of a printing section of the printer.

In FIG. 5, reference numerals 10, 11 and 12 respectively designate a thermal head, a piece of image-receiving paper and a platen roller. Reference numerals 13 and 14 respectively designate unused and used ink ribbons.

Figure 6:
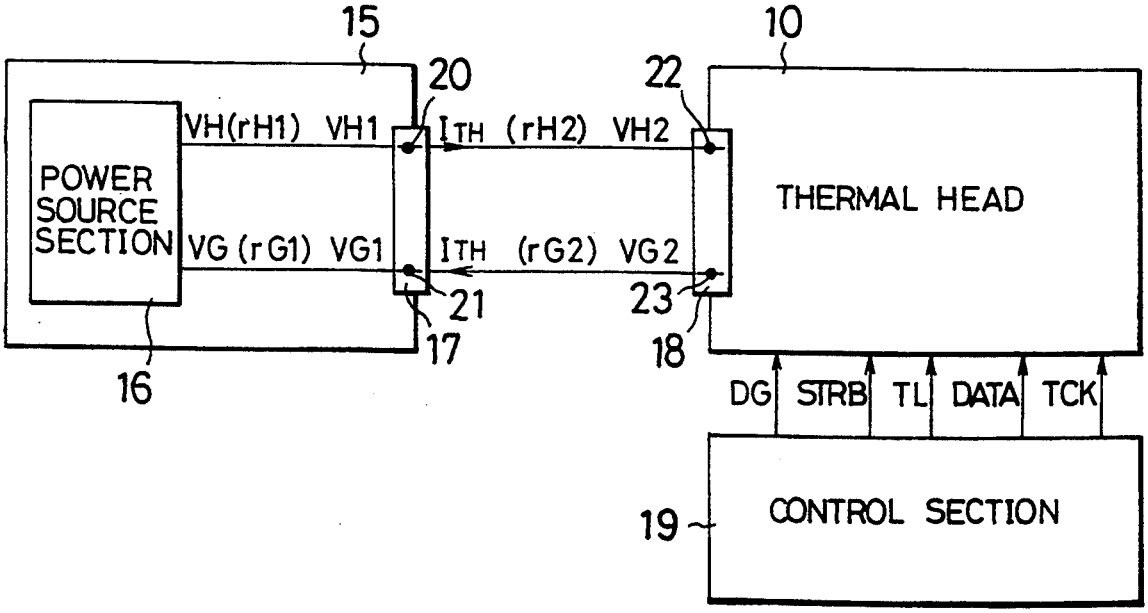
Figure 7A:
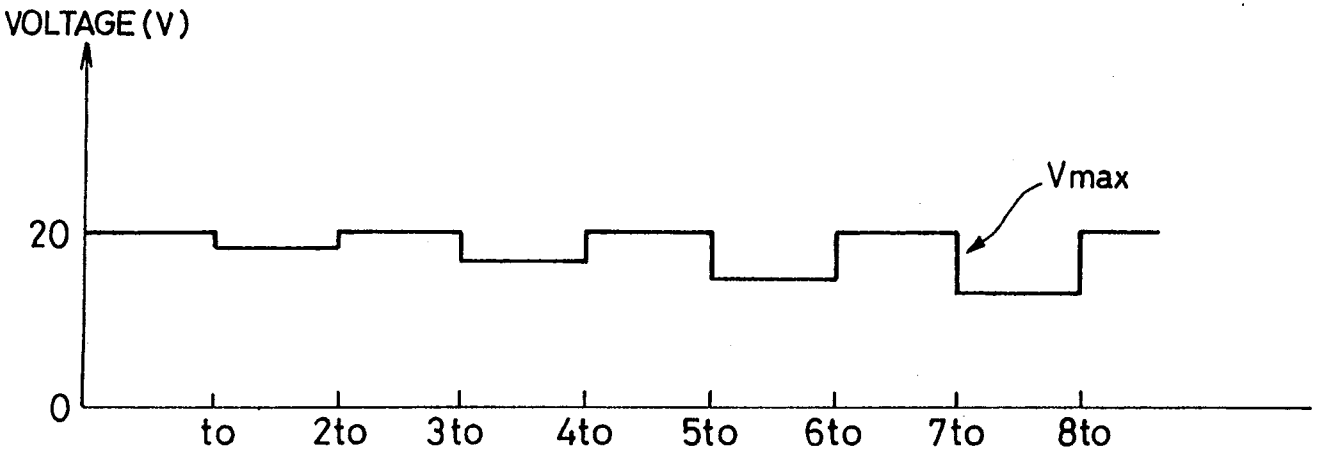
FIGS. 7*a* and 7*b* are timing charts for explaining a change in voltage applied to the thermal head in a state in which an electric current flows through a resistor of the thermal head.
Figure 7B:
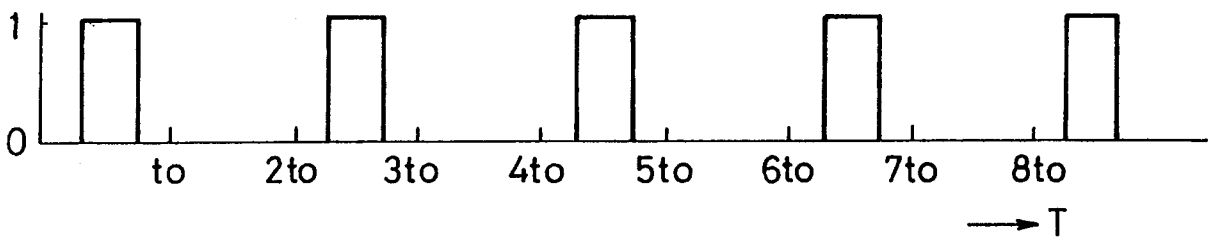

FIG. 6 shows a control section 19, the thermal head 10 and a power source unit 15 arranged in the printer.

A power source section 16 of the power source unit 15 constitutes a power source for the thermal head. Reference numeral VH designates an output voltage of this power source section 16. Reference numeral VG designates a ground voltage of the power source section 16. These voltages VH and VG are applied to a connector 17 in an output section of the power source unit 15 through a substrate pattern and jumper lead wires.

Reference numeral VH1 designates an output voltage at a connection point 20 of this connector 17. Reference numeral VG1 designates a ground voltage at a connection point 21 of the connector 17. These connection points 20 and 21 are respectively connected to connection points 22 and 23 of an input connector 18 of the thermal head through lead wires. Reference numerals VH2 and VG2 respectively designate voltages at these connection points 22 and 23.

Reference numeral rill designates a resistance value from the power source section 16 to the connection point 20. Reference numeral rG1 designates a resistance value from the power source section 16 to the connection point 21. Reference numeral rH2 designates a resistance value from the connection point 20 to the connection point 22. Reference numeral rG2 designates a resistance value from the connection point 21 to the connection point 23. The relation of rH1=rG1 is normally formed and rH1 and rG1 in this relation are set to r1. Further, the relation of rH2=rG2 is normally formed and rH2 and rG2 in this relation are set to r2.

Reference numeral $I_{TH}$ designates a sum of electric currents flowing through the resistors $R_{TH2}$,—, $R_{THn}$ of the thermal head 10. In this case, $VG1-VG=I_{TH}r1$ is formed and $(VH-VG)-(VH2-VG2)=2\ (r1+r2)\ I_{TH}$ is also formed.

$I_{THMAX}$ designates a current sum $I_{TH}$ provided when electric currents flow through all the resistors.

FIG. *7a* shows a change in voltage difference (VH2−VG2) when (VH−VG) is equal to 20 volts and electric currents flow through a quarter of all the resistors at a time interval from time t0 to time 2t0. FIG. *7a* also shows a change in voltage difference (VH2−VG2) when (VH−VG) is equal to 20 volts and electric currents flow through a half of all the resistors at a time interval from time 3t0 to time 4t0. FIG. *7a* also shows a change in voltage difference (VH2−VG2) when (VH−VG) is equal to 20 volts and electric currents flow through three quarters of all the resistors at a time interval from time 5t0 to time 6t0. FIG. *7a* also shows a change in voltage difference (VH2−VG2) when (VH−VG) is equal to 20 volts and electric currents flow through all the resistors at a time interval from time 7t0 to time 8t0. In this case, $V_{max}$ is equal to $2\ (r1+r2)I_{TH}$.

Figure 2:
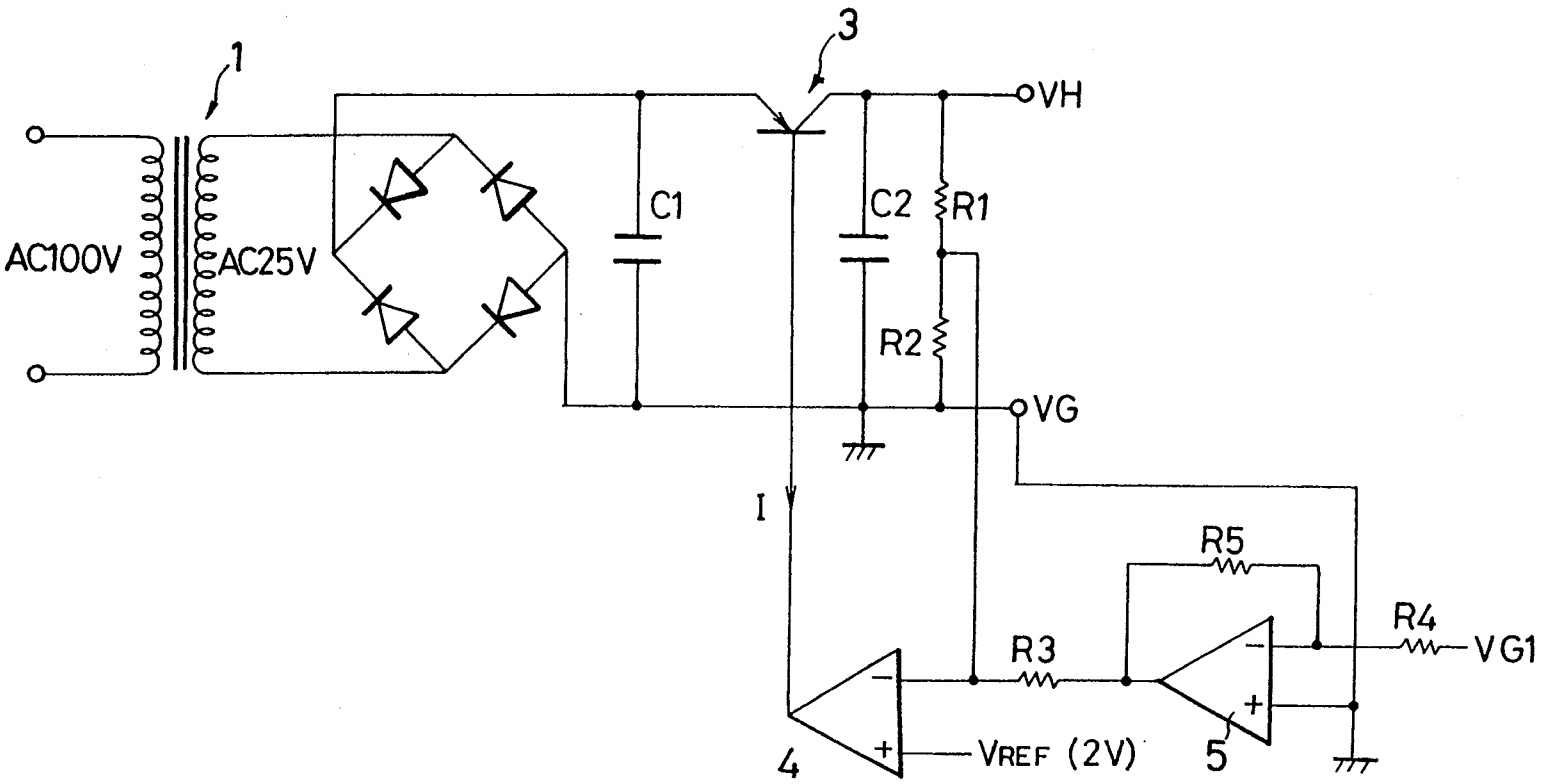
FIG. 2 is a circuit diagram showing a power source for a thermal printer in accordance with one embodiment of the present invention.

FIG. 2 shows a power source for a thermal printer in accordance with one embodiment of the present invention.

In FIG. 2, reference numeral 5 designates a differential amplifier. Reference numerals C1 and C2 designate capacitors. Reference numerals R1 to R5 designate resistors. Reference numerals VH and VG designate voltages of output terminals. Reference numeral VG1 designates a voltage applied to the differential amplifier 5. Reference numeral $V_{REF}$ designates a voltage inputted to a plus (+) input terminal of a differential amplifier 4 and this voltage $V_{REF}$ is set to 2 volts.

In this case, a terminal voltage difference (VH−VG) is provided by the following formula.

$$(VH-VG)=(R1\cdot R2+R2\cdot R3+R3\cdot R1)\ V_{REF}/(R2\cdot R3)+R1\cdot R5\cdot VG1/(R3\cdot R4)$$

When R1=9 kΩ, R2=R3=2 kΩ and $V_{REF}$=2 V are set (VH−VG) is provided as follows.

$$(VH-VG)=20V+4.5R5\cdot VG1/R4$$

In this case, $VG1=I_{TH}r1$ is formed.

If an electric circuit of the power source is set such that the following formula $$4.5R5\cdot VG1/R4=2(r1+r2)I_{TH}$$

is formed, (VH2−VG2) is equal to a constant value of 20 V at any time irrespective of any value of $I_{TH}$.

Namely, it is possible to provide a stable power source for a thermal head with respect to any value of $I_{TH}$ if R5 and R4 are set such that the following formula $$4.5R5(I_{TH}\cdot r1)/R4=2(r1+r2)I_{TH}$$

is formed. In other words, it is possible to provide a stable power source for a thermal head with respect to any value of $I_{TH}$ if R5 and R4 are set such that the ratio of R5 to R4 is equal to 2 (r1+r2)/4.5r1.

In the above description, a voltage drop within the thermal head is set to zero. However, this voltage drop may be adjusted and set to be nonzero by suitably selecting a ratio of R4 and R5.

Figure 3:
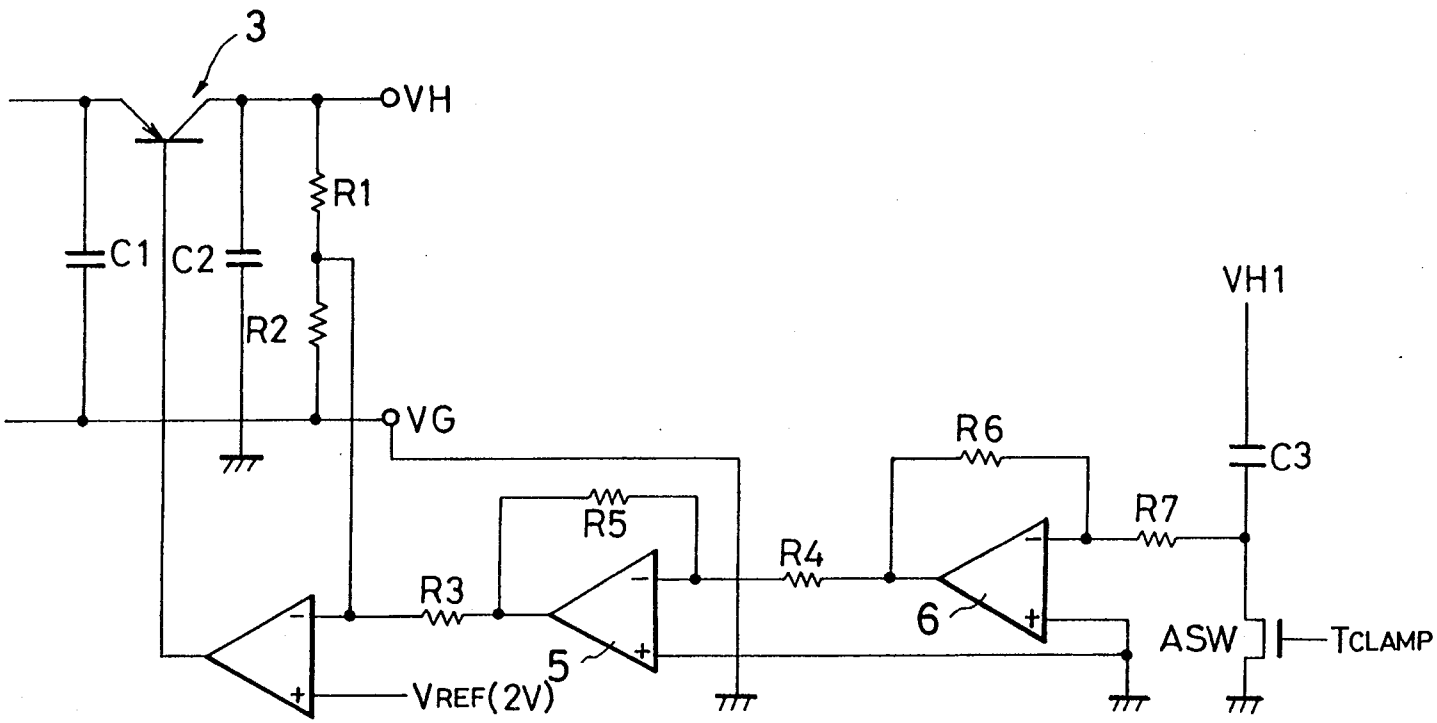
FIG. 3 is a circuit diagram showing a power source for a thermal printer in accordance with another embodiment of the present invention.

FIG. 3 shows a power source for a thermal printer in accordance with another embodiment of the present invention.

In FIG. 3, a differential amplifier 6 is used as an inverting amplifier of a gain −1. An analog switch ASW is turned on when signal $T_{CLAMP}$ shows value "1". Reference numeral C3 designates a capacitor for cutting or removing a direct current. As shown in FIG. *7b*, signal $T_{CLAMP}$ shows value "1" while no thermal head prints characters. In the embodiment shown in FIG. 3, a feedback voltage from VH1 is corrected instead of VG1.

In the above embodiments of the present invention, a compensating circuit has differential amplifiers 4, 5 and resistors R3, R4, R5. The compensating circuit detects a load electric current supplied to a printer only within the power source and is constructed such that a reduction in voltage applied to the printer is compensated in accordance with the load electric current. Accordingly, the reduction in power voltage caused by an increase in printing amount is corrected by only a power source unit so that a stable voltage can be applied to the printer. Further, when the power source of the present invention is used for the printer, it is possible to prevent a defect in a connector and an excessive voltage from being caused in the printer and obtain printed characters having a uniform density.

Many widely different embodiments of the present invention may be constructed without departing from the spirit and scope of the present invention. It should be understood that the present invention is not limited to the specific embodiments described in the specification, except as defined in the appended claims.

What is claimed is:

1. A power source for a printer, comprising:

a direct current power source;

an output lead wire and aground lead wire each connecting said direct current power source and a printer to each other;

a compensating circuit having an input connected to a divided voltage output of said direct current power source and an output connected to said output lead wire for compensating a reduction in voltage applied to said printer from said direct current power source in response to a load electric current passing through said output lead wire;

a first differential amplifier having first and second inputs and an output, said first input being connected to ground and said output being connected to an input of said compensating circuit; and a second differential amplifier having a first input connected to ground and an output connected to said second input of said first differential amplifier, said second differential amplifier further having a second input connected to said output lead wire through a direct current blocking means and being connected to ground through thermal print head synchronizing means.

2. A power source according to claim 1, wherein said direct current blocking means comprises a capacitor, and said thermal print head synchronizing means comprises an analog switch.

* * * * *